US005791096A

United States Patent [19]

Chen

[11] Patent Number: 5,791,096

[45] Date of Patent: Aug. 11, 1998

[54] RAISED FLOOR SUPPORTING STRUCTURE

[76] Inventor: Kingbow Chen, 7F-3, No. 127, Sec.1, Keelung Road, Taipei City, Taiwan

[21] Appl. No.: 812,497

[22] Filed: Mar. 7, 1997

[51] Int. Cl.[6] ..... E04B 5/43; E04F 15/00

[52] U.S. Cl. ..... 52/126.6; 52/126.7; 52/263; 52/220.1

[58] Field of Search ..... 52/126.6, 126.7, 52/263, 220.1

[56] References Cited

U.S. PATENT DOCUMENTS

| | | | |
|---|---|---|---|
| 3,222,030 | 12/1965 | Thorpe | 52/126.6 X |
| 3,470,663 | 10/1969 | Tate | 52/126.6 |
| 4,922,670 | 5/1990 | Naka et al. | 52/126.6 |
| 4,982,539 | 1/1991 | Hiller | 52/263 |
| 4,996,804 | 3/1991 | Naka et al. | 52/263 X |
| 5,048,242 | 9/1991 | Cline | 52/126.6 |
| 5,412,914 | 5/1995 | Daw et al. | 52/126.6 |

*Primary Examiner*—Robert Canfield

*Attorney, Agent, or Firm*—Morton J. Rosenberg; David I. Klein; Jun Y. Lee

[57] ABSTRACT

A raised floor supporting structure including a plurality of upright supports, a plurality of top stretchers and bottom stretchers respectively connected between the upright supports at different elevations, wherein each upright support is comprised of a circular base having an upright socket and radial reinforcing ribs extended from the upright socket, a reinforced upright tube mounted in the upright socket of the circular base and covered with a top cap, a screw member inserted through the center hole of the top cap into the upright tube, a nut threaded onto the screw member and supported on the top cap and turned to adjust the elevation of the screw member, a bracket mounted on the screw member at the top for holding floor panels; each top stretcher has a coupling portion at each end respectively coupled to a respective coupling portion of the bracket of one upright support, and a pin hole at each end respectively coupled to a respective upright pin of the bracket of the corresponding upright support; each bottom stretcher has a coupling portion at each end respectively coupled to one reinforcing rib of the circular base of one upright support, and a pin hole at each end respectively coupled to a respective upright pin at the corresponding reinforcing rib of the circular base of the corresponding upright support.

1 Claim, 4 Drawing Sheets

RAISED FLOOR SUPPORTING STRUCTURE

BACKGROUND OF THE INVENTION

The present invention to a supporting structure for a raised floor which is easy to install, strong and durable in use, and inexpensive to manufacture.

Raised floors are commonly used in laboratories, clean rooms, etc. FIG. 4 shows an upright support for a supporting structure for a raised floor according to the prior art, in which a base plate 3 is fixed on the floor concrete, an upright tube 31 is mounted in the top center socket of the base plate 3, a top cap 32 is mounted on the top end of the upright tube 31, a screw rod 33 is inserted through the center hole of the top cap 32 into the upright tube 31, and a frame 35 is mounted on the screw rod 33 at the top. When a plurality of upright supports are installed, top beams 36 are respectively fastened between the upright supports, and floor panels are respectively mounted on the upright supports. This structure of upright support has drawbacks. Because the upright tube is a typically smooth, it cannot bear much pressure. In order to increase the compressive strength of the upright tube, the wall thickness of the upright tube must be relatively increased. However, increasing the wall thickness or the diameter of the upright tube simultaneously increases its weight. When a heavy upright tube is used, the delivery and assembly of the upright support become inconvenient. Another drawback of this structure of upright support is its low seismic strength. Because only one top beam is connected between two upright supports, the upright supports of a raised floor made according to this structure tend to be forced to deform in one direction or to fall when bearing high seismic waves or a continuous transverse force. Furthermore, this structure of upright support has no means for holding down electrical cables.

SUMMARY OF THE INVENTION

The present invention has been conducted to provide a new supporting structure for a raised floor which eliminates the aforesaid drawbacks. According to one aspect of the present invention, the raised floor supporting structure including a plurality of upright supports, a plurality of top stretchers and bottom stretchers respectively connected between the upright supports at different elevations, wherein each upright support is comprised of a circular base having an upright socket and radial reinforcing ribs extended from the upright socket, a reinforced upright tube mounted in the upright socket of the circular base and covered with a top cap, a screw member inserted through the center hole of the top cap into the upright tube, a nut threaded onto the screw member and supported on the top cap and turned to adjust the elevation of the screw member, a bracket mounted on the screw member at the top for holding floor panels; each top stretcher has a coupling portion at each end respectively coupled to a respective coupling portion of the bracket of one upright support, and a pin hole at each end respectively coupled to a respective upright pin of the bracket of the corresponding upright support; each bottom stretcher has a coupling portion at each end respectively coupled to one reinforcing rib of the circular base of one upright support, and a pin hole at each end respectively coupled to a respective upright pin at the corresponding reinforcing rib of the circular base of the corresponding upright support. Because top stretchers and bottom stretchers are respectively connected between the brackets of the upright supports and the radial reinforcing ribs of the circular bases thereof, the seismic strength of the supporting structure is greatly reinforced. According to another aspect of the present invention, the upright tube is reinforced by longitudinal reinforcing ribs, therefore the upright tube has high buckling strength. According to still another aspect of the present invention, the circular base of each upright support comprises a top-notched upright wire holder raised from the top side and adapted for holding an electrical cable. The top-notched upright wire holder comprises a female screw raised from the top side of the circular base and having a notched top end, and a screw threaded into the female screw to effectively hold down an electrical cable in the notched top end.

DETAILED DESCRIPTION OF THE PREFERRED EMBODIMENT

Figure 1:
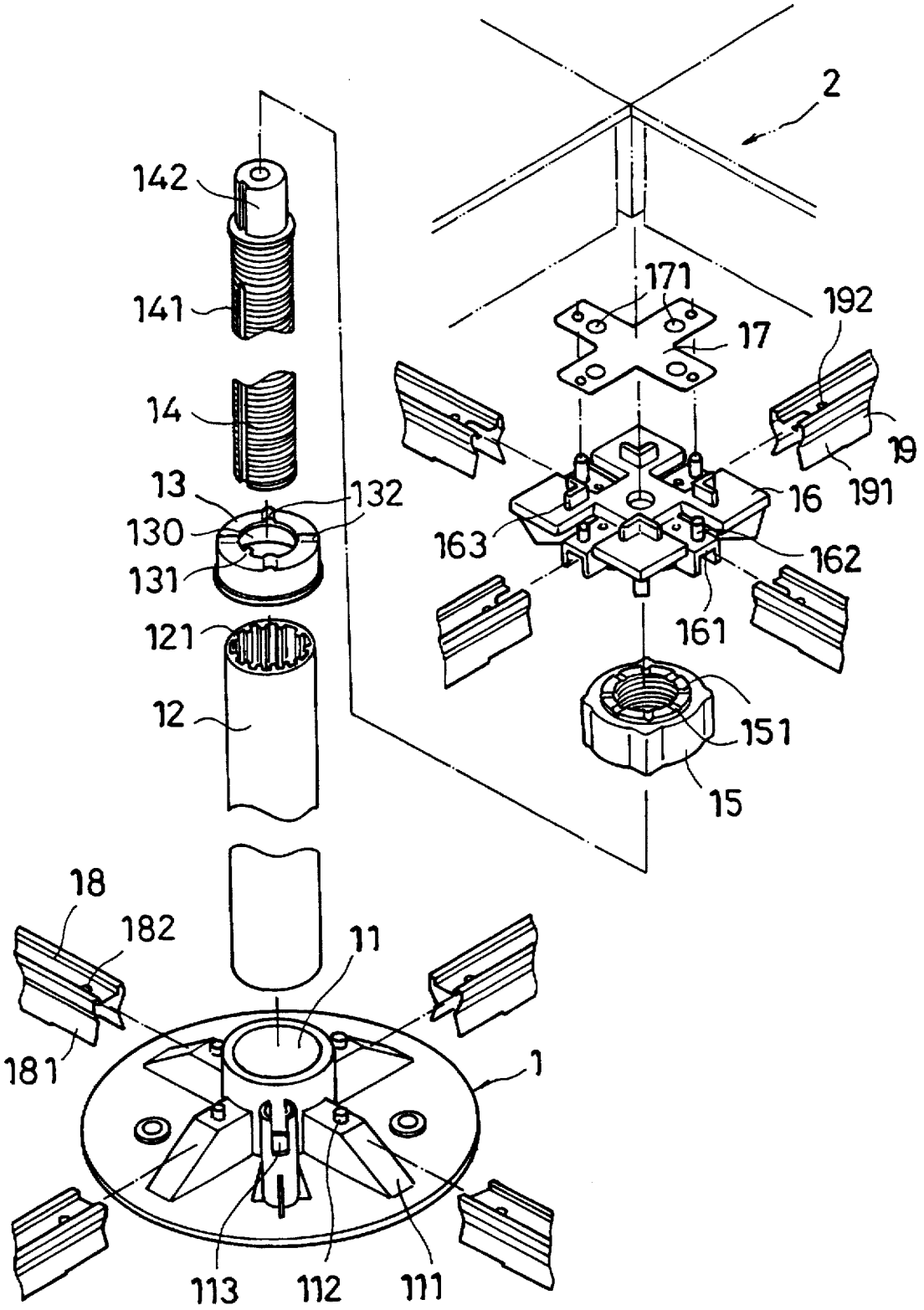
FIG. 1 is an exploded view of an upright support according to the present invention.
Figure 2:
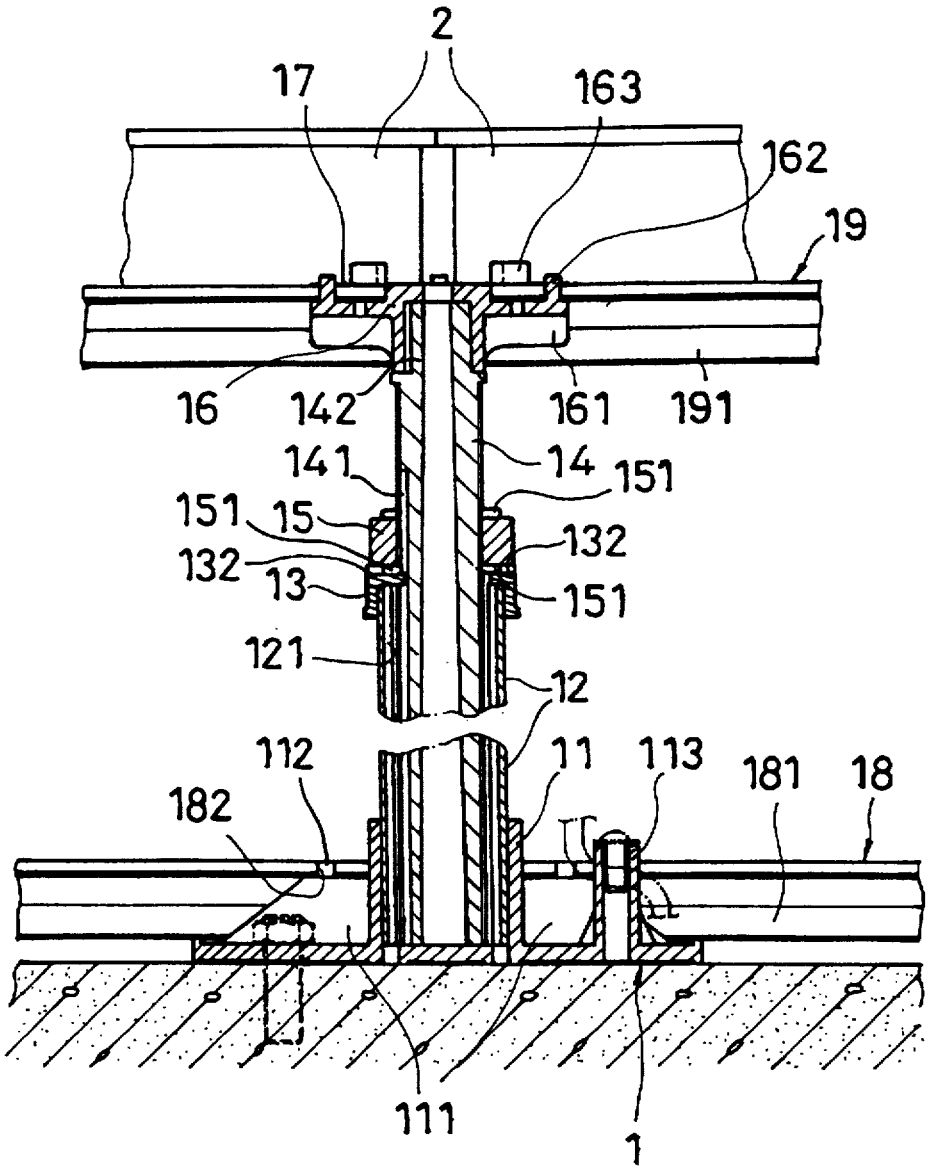
FIG. 2 is a sectional assembly view of the upright support shown in FIG. 1.

Referring to FIGS. 1 and 2, the circular base, referenced by 1, comprises an upright socket 11 raised from the top at the center, four radial reinforcing ribs 111 raised from the top and equiangularly extended from the upright socket 11, four upright pins 112 respectively raised from the radial reinforcing ribs 111, a top-notched upright wire holder 113 raised from the top and adapted for holding an electrical cable. The top-notched upright wire holder 113 is made in the form of a female screw having a notched top end. When an electrical cable is inserted through the notched top end, a screw is threaded into the notched top end of the top-notched upright wire holder 113 to hold down the electrical cable in place. An upright supporting tube 12 is provided having a bottom end fitted into the upright socket 11 of the circular base 1. Longitudinal reinforcing ribs 121 are raised from the inside wall of the upright supporting tube 12 to reinforcing its structural strength. A top cap 13 is mounted on the top end of the upright supporting tube 12, having a top center hole 130, an inside flange 131 raised from the periphery of the top center hole 130, and a plurality of radial locating grooves 132 radially extended from the top center hole 130 at the top. A screw member 14 is inserted through the top center hole 130 of the top cap 13 into the upright supporting tube 12, having a longitudinal sliding slot 141 extended from the bottom end to a certain height and forced into engagement with the inside flange 131 of the top cap 13, and an upright extension rod 142 at the top. A nut 15 is threaded onto the screw member 14 and stopped above the top cap 13, having radial ribs 151 at top and bottom sides thereof. When the nut 15 is installed, the radial ribs 151 at the bottom side are respectively forced into engagement with the radial locating grooves 132 of the top cap 13. A substantially rectangular bracket 16 is mounted on the screw member 14 and coupled to the upright extension rod 142, having four coupling portions 161 respectively disposed at the four sides, four upright pins 162 respectively raised from the coupling portion 161, and four angle stops 163 respectively raised from the top side and spaced by the coupling portions 161. A crossed sound-proof cushion 17 is mounted on the bracket 16 at the top, having four pin holes 171 at the four ends respectively coupled to the upright pins 162 of the bracket 16. When the aforesaid structure is assembled, the nut 15 can be turned to adjust the elevation of the screw member 14.

Figure 3:
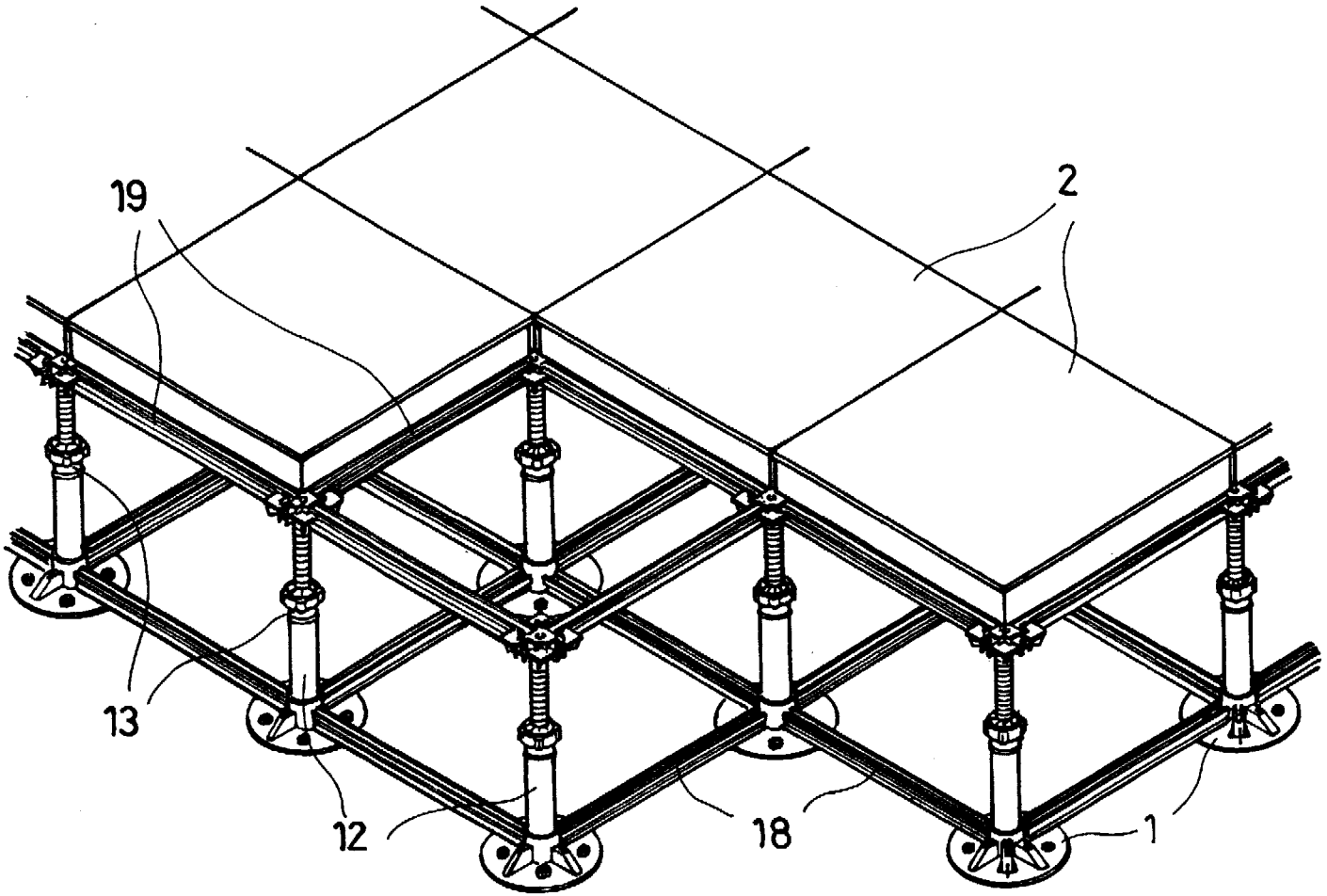
FIG. 3 is an elevational view showing an upright supporting structure set up according to the present invention.
Figure 4:
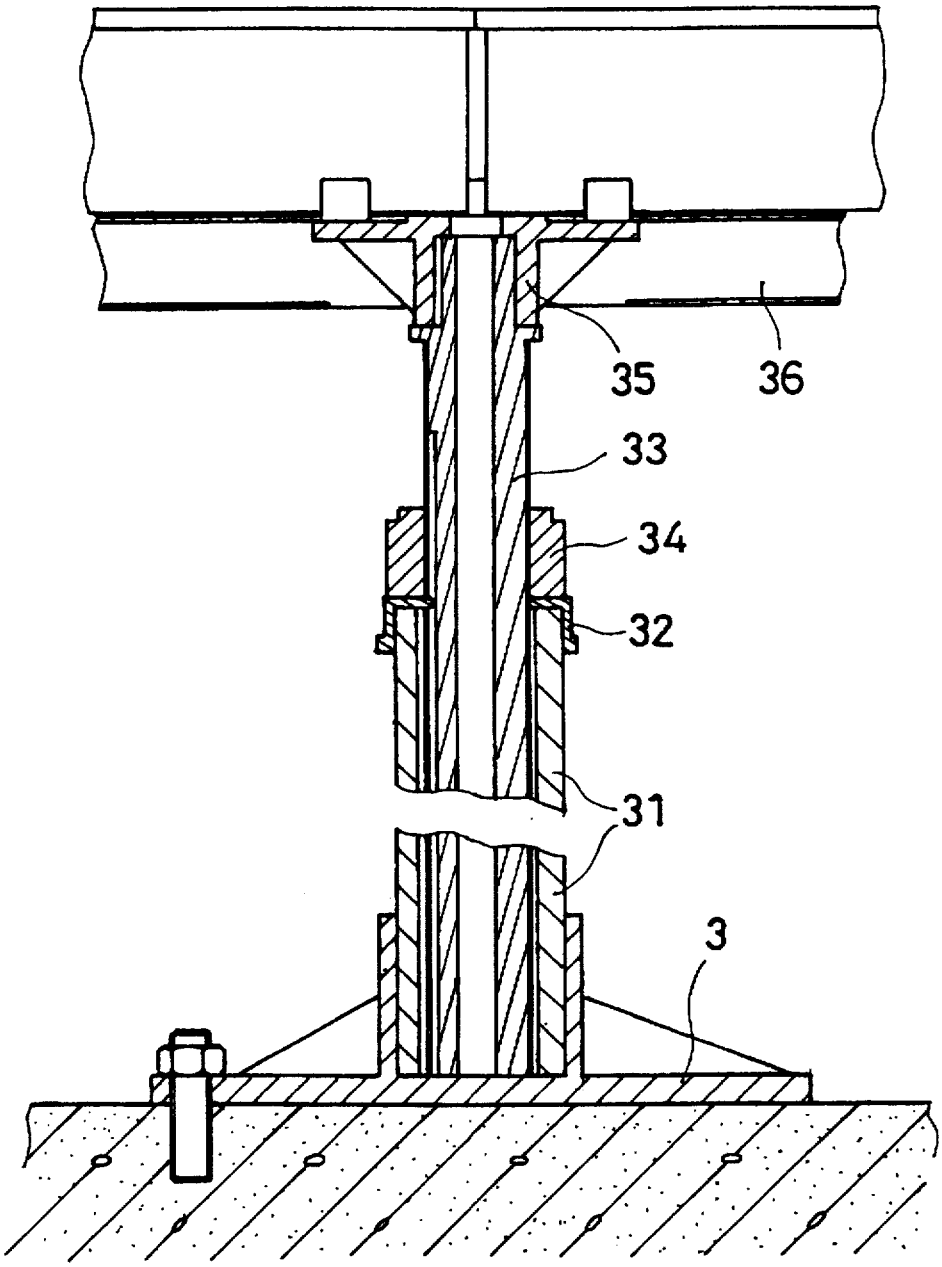
FIG.4 PRIOR ART
FIG. 4 is a sectional assembly view of an upright support for a raised floor according to the prior art.

Referring to FIG. 3, top stretchers 19 and bottom stretchers 18 are respectively connected between the coupling portions 161 of the brackets 16 and the radial reinforcing ribs 111 of the circular bases 1, and flat, hollow, rectangular floor panels 2 are respectively mounted on the brackets 16 and the top stretchers 19 and coupled to the angle stops 163. Each bottom stretcher 18 has a channel-like coupling portion 181 at each end respectively coupled to one radial reinforcing rib 111 of one circular base 1, and a pin hole 182 at each end respectively coupled to the upright pin 112 of the corresponding radial reinforcing rib 111. Each top stretcher 19 has a channel-like coupling portion 191 coupled to one coupling portion 161 of one bracket 16, and a pin hole 192 coupled to the upright pin 162 of the corresponding coupling portion 161.

It is to be understood that the drawings are designed for purposes of illustration only, and are not intended as a definition of the limits and scope of the invention disclosed.

What the invention claimed is:

1. A raised floor supporting structure adapted for supporting flat, hollow, rectangular floor panels, comprising a plurality of upright supports longitudinally and transversely aligned, a plurality of top stretchers and bottom stretchers respectively connected between said upright supports at different elevations, wherein each of said upright supports comprises a circular base, an upright supporting tube, a top cap, a screw member, a nut, a bracket, and a crossed sound-proof cushion, said circular base comprising a top side, an upright socket raised from the top side at the center, four radial reinforcing ribs raised from the top side and equiangularly extended from said upright socket, four upright pins respectively raised from said radial reinforcing ribs, a top-notched upright wire holder raised from the top side and adapted for holding an electrical cable, said top-notched upright wire holder comprising a female screw raised from the top side of said circular base and having a notched top end, and a screw threaded into said female screw to hold down an electrical cable in said notched top end, said upright supporting tube having a bottom end fitted into said upright socket of said circular base, a top end, and a plurality of longitudinal reinforcing ribs raised from an inside wall thereof, said top cap being mounted on the top end of said upright supporting tube, having a top center hole, an inside flange raised from the periphery of said top center hole, and a plurality of radial locating grooves radially extended from said top center hole at a top side thereof, said screw member being inserted through the top center hole of said top cap into said upright supporting tube, having a longitudinal sliding slot extended from a bottom end thereof and forced into engagement with the inside flange of said top cap, and an upright extension rod raised from a top end thereof, said nut being threaded onto said screw member and stopped above the top cap, having a plurality of radial ribs raised from a bottom side thereof and respectively forced into engagement with the radial locating grooves of said top cap, said bracket being mounted on said screw member and coupled to said upright extension rod of said screw member, having four coupling portions respectively disposed at four sides, four upright pins respectively raised from said coupling portion, and four angle stops respectively raised from a top side thereof and spaced by said coupling portions and adapted for holding a respective floor panel, said crossed sound-proof cushion being mounted on said bracket, having four pin holes at four ends thereof respectively coupled to the upright pins of said bracket; each of said bottom stretchers has a channel-like coupling portion at each end respectively coupled to one radial reinforcing rib of the circular base of one upright support, and a pin hole at each end respectively coupled to the upright pin of the corresponding radial reinforcing rib; each of said top stretchers has a channel-like coupling portion at each end respectively coupled to one coupling portion of the bracket of one upright support, and a pin hole at each end respectively coupled to the upright pin of the corresponding coupling portion of the corresponding bracket.

* * * * *